United States Patent [19]

Ashton

[11] 4,135,357

[45] Jan. 23, 1979

[54] SOLAR CHRONOMETER

[75] Inventor: George Ashton, Studio City, Calif.

[73] Assignee: L. M. Dearing Associates, Inc., Studio City, Calif.

[21] Appl. No.: 807,217

[22] Filed: Jun. 16, 1977

[51] Int. Cl.[2] ..... G04B 49/04

[52] U.S. Cl. ..... 58/1 R; 58/4 R; 33/270

[58] Field of Search ..... 58/3, 4 R, 127 R, 1 R; 33/270, 269, 271

[56] References Cited

U.S. PATENT DOCUMENTS

| | | | |
|---|---|---|---|
| 303,118 | 8/1884 | Christian | 33/270 |
| 978,859 | 12/1910 | Dick | 33/270 |
| 1,570,029 | 1/1926 | Balch | 33/270 |
| 2,192,750 | 3/1940 | Mead | 33/270 |

FOREIGN PATENT DOCUMENTS

| | | | |
|---|---|---|---|
| 1660 of | 1892 | United Kingdom | 33/270 |

*Primary Examiner*—Robert K. Schaefer
*Assistant Examiner*—William L. Feeney

[57] ABSTRACT

A solar chronometer in which a style is aligned with the celestial pole and an equatorial member, preferably in the shape of a ring, is aligned with the equator. The style and equatorial member cast shadows upon a chart and the point where the shadows intersect indicates the hour and the date.

22 Claims, 9 Drawing Figures

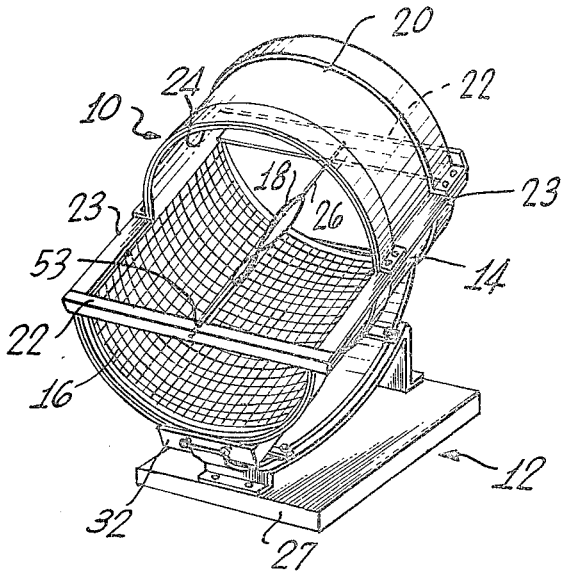
Fig. 1
Fig. 3
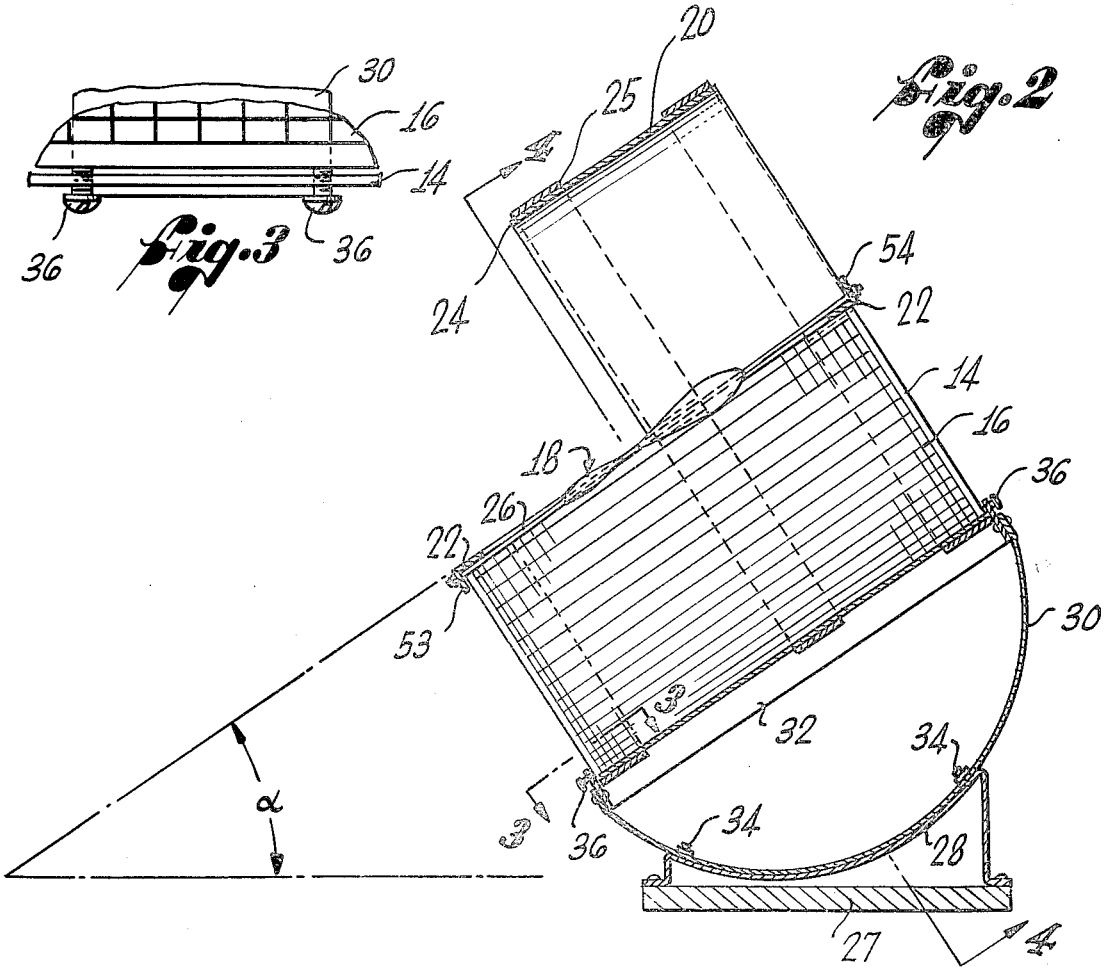
Fig. 2

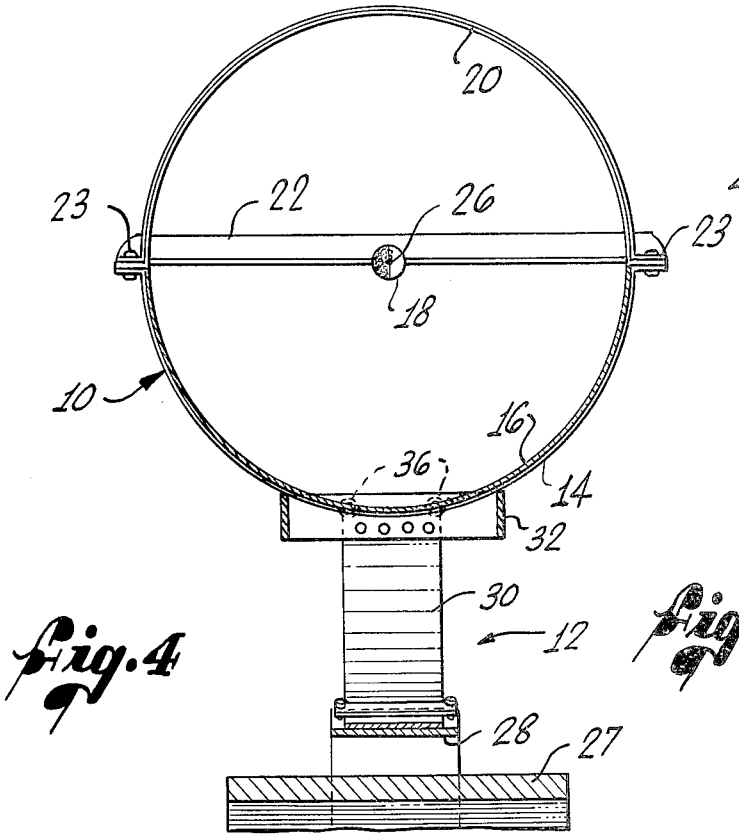
Fig. 4
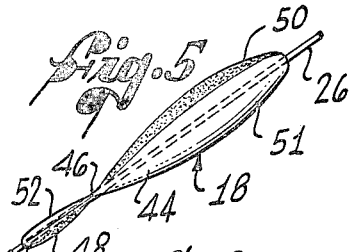
Fig. 5
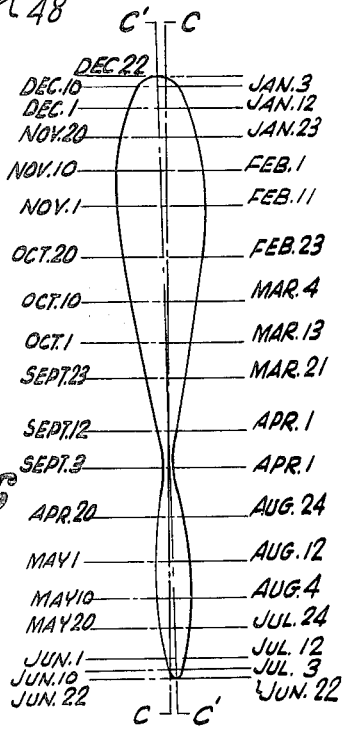
Fig. 6
Fig. 7
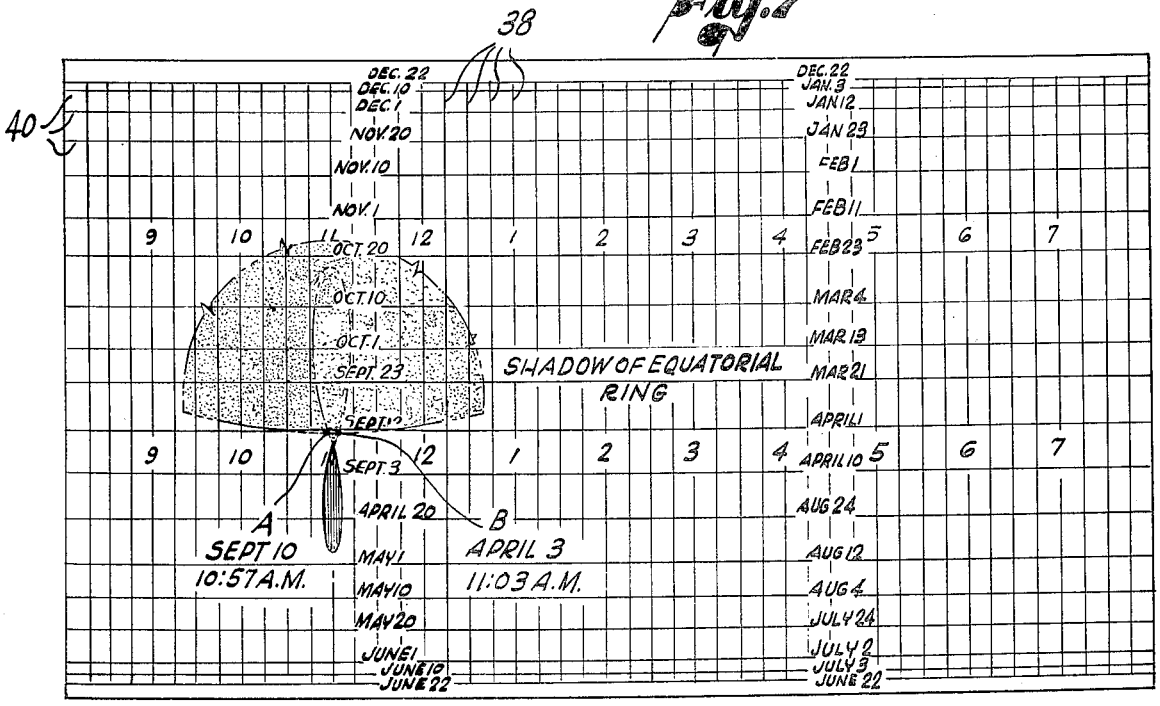

SOLAR CHRONOMETER

BACKGROUND OF THE INVENTION

The present invention relates to gnomonics or sciatherics, the art of constructing solar chonometers. More particularly, it relates to the construction of solar instruments which, in addition to the time of day, can indicate the day of the year.

Solar chomometers are among the most ancient instruments to which man has applied his scientific ability. One of the oldest references to solar chonometers, or sun dials, in biblical, found at Isaiah 38:8. Perhaps the oldest sun dial of known construction is credited to Berossus (c. 300 B.C.) and employed a hollow hemisphere provided with a bead that cast a shadow onto its concave inside surface.

The variety of sun dials that have been developed, including horizontal, vertical, equatorial, armillary, spherical, cross and star dials, has expanded greatly over the centuries. The various types of dials and their principles of operation are described and explained in *Sundials,* Frank W. Cousins, John Baker Publishers Limited, 1972.

Solar chonometers have, of course, improved considerably over the centuries. A principal improvement is found in the construction of dials that indicate mean solar time (the time indicated by a conventional clock running at a uniform rate) rather than apparent solar time. These two times differ because the length of a true solar day varies from one day to the next due to the ellipticity of the earth's orbit. Complex variations in the difference between apparent solar time and mean solar time are described by the "equation of time", found in tabular form in the widely used *Whitacker's Almanac.*

There are only four times during the course of a year when the correction required by the equation of time is zero. The discrepancy reaches a maximum of sixteen minutes, nineteen seconds on the third of November.

The most common technique for causing a sun dial to indicate mean solar time is the use of an analemmic style, the style being a fixed member that casts a shadow upon a scale of hours. An analemmic style, or analemma, is curved so that a shadow is cast at different positions on the scale depending upon the sun's declination. Since declination varies with the day of the year, the curvature can be such that the sunlight falling upon the scale is always positioned at a point that is correct in accordance with the value of the equation of time for that day.

A solar chronometer with an analemma formed by a solid body having the shape of a three-dimensional figure eight was patented in Great Britian in 1892 by Major-General Oliver. This instrument requires the alternate use of two differently shaped analemmas, each appropriate for only one half of the year. Another sun dial, attributed to Richard L. Schmoyer, utilizes a plate with an elongated slot for the style and the style must be rotated to face the sun at each reading.

Another improvement in solar chronometers is represented by Ferguson's Chronometer, on display at the Science Museum in London, which corrects for the equation of time using two abutting tapered rods which cast a shadow that indicates a point rather than a line. This shadow is projected onto a chart having a series of curved hour lines that the shadow moves across to indicate the time of day. The sun's declination causes the shadow to move up and down the lines as the date changes so that the curvature of the lines and the position of the shadow combine to build the equation of time into the reading, thus giving mean solar time. While movement of the shadow across the hour lines of Ferguson's chronometer indicates mean solar time, movement on a perpendicular axis aligned with the celestial pole indicates the day of the year.

It is a principal objective of the present invention to provide an improved and more easily read solar chonometer, one that can accurately indicate both the time of day and the day of the year.

SUMMARY OF THE INVENTION

The present invention comprises a solar chronometer which utilizes two intersecting shadows to indicate the time in a highly readable manner. It can indicate the date as well, since the position of the intersection is dependent, in one direction, upon the sun's declination.

Structurally, the invention includes a style, which may be an analemma in the shape of a three-dimensional figure eight, and an equatorial member, which may form part of a ring. A support includes provisions for aligning the style with the celestial pole and for aligning the equatorial member with the equator. Shadows are cast by the style and the equatorial member onto a chart which carries indicia that can be compared to the position of their intersection to determine the hour of the day. When an analemma is used, the hour indicia may include straight lines parallel to its longitudinal axis. When the style is a gnomon, mean solar time can still be read instead of apparent solar time, but the lines of the hour indicia must be curved. Two sets of curved lines are used, one for each half of the year. Whether a gnomon or analemma is used, the date can be determined by reference to date indicia which may include straight lines parallel to the style.

In a preferred embodiment, the chart defines part of the interior surface of a cylinder. The equatorial ring is approximately one half the width of the chart and casts only one shadow upon the chart in the area of the intersection of concern, thereby avoiding potential confusion. The edge of the equatorial ring should be thin, so the position of the shadow does not shift as the direction from which the sunlight is incident upon the ring changes. A structural member that supports the thin edge is recessed and therefore does not affect the shadow.

In an embodiment of the invention particularly suitable for use in high latitude regions, where there are sometimes more hours of sunlight, the chart consists of a center section and two end sections, the end sections being connected to the center section by hinges. One end section is raised at a time to determine the time and date at the beginning or end of the day, while the other end section is dropped away from the path of the light so that it does not cast an intefering shadow.

Other features and advantages of the present invention will become apparent from the following detailed description of preferred embodiments thereof and the attached drawings, which illustrate, by way of example, the principles of the invention.

BRIEF DESCRIPTION OF THE DRAWINGS

FIG. 1 is a pictorial view of a solar chronometer that embodies many novel features of the present invention;

FIG. 2 is a cross-sectional side view of the chronometer of FIG. 1;

FIG. 3 is a fragmentary plan view of the chronometer taken along the line 3 — 3 of FIG. 2;

FIG. 4. is a cross-sectional view taken along the line 4 — 4 of FIG. 2;

FIG. 5 is a pictorial view of the analemma of the chronometer;

FIG. 6 is a schematic drawing of the analemma of the chronometer;

FIG. 7 shows the chart of the chronometer projected onto a flat surface;

DESCRIPTION OF A PREFERRED EMBODIMENT

Figure 8:
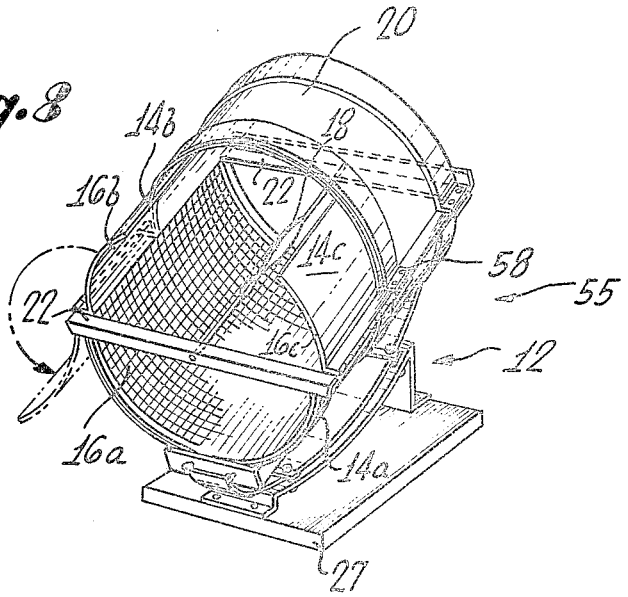
FIG. 8 is a pictorial view of a second embodiment of the invention that is particularly suited for use in high latitude regions.

An exemplary solar chronometer 10 embodying many novel features of the present invention is shown in FIGS. 1–7. Its major components, as best shown in FIG. 1, include a stand 12 that positions a chart support 14 and a chart 16, an analemmic style 18, and an equatorial ring 20.

The chart support 14 takes the shape of a half-cylinder having its concave surface facing upwardly. Two cross-pieces 22 connect the corners of the support 14. The chart 16 is laid against the concave surface and bound along its edges so that its exposed face likewise defines part of the interior surface of a cylinder.

The equatorial ring 20 has half the width of the chart 16, and is joined to the edges of the chart support 14 along opposing longitudinal flanges 23 to comlete a portion of the cylinder. The leading edge 24 of the ring 20 is very thin, about twenty thousandths of an inch, so that the shadow it casts on the chart 16 is not shifted significantly as the sun crosses the edge. A thicker, arcuate, exterior, supporting member 25 is set back from the leading edge 24 so that it does not cast a shadow on the chart 16.

A thin shaft 26 extending from one cross-piece 22 to the other suspends the analemma 18 so that it lies approximately along the longitudinal center axis of the cylinder. The analemma 18 has the shape of a three-dimensional figure eight (the volume defined by the revolution of a figure 8) and is centered between the two cross-pieces 22. Its length is one half the longitudinal dimension of the chart 16.

The stand 12 includes a flat base 27 to which is attached a concave, arcuate track 28 which receives an overlying arcuate carriage 30 that connects the opposite ends of an open rectangular frame 32. The convex bottom surface of the chart support 14 is received within the frame 32.

It is essential that the longitudinal axis of the analemma 18 be aligned in accordance with and parallel to the earth's celestial pole. This is accomplished by first turning the stand 12 until the axis of the analemma 18 lies in the same plane as the celestial pole. Then the carriage is rotated within the track 28 until the analemma 18 lies parallel to the celestial pole. Since the edge of the equatorial ring 20 is perpendicular to the anelemma 18, it is then aligned with (made parallel to) the equator. Set screws 34 hold the carriage 30 in its adjusted position with respect to the track 28. The chart 16 and chart support 14 are then rotated within the frame 32 until the chart 16 is positioned to indicate the correct time, as explained below. A second set of screws 36 then anchors the support 14, as best shown in FIG. 3.

Two shadows are cast upon the chart 16, one from the analemma 18 and one from the equatorial ring 20, as shown in FIGS. 1–7. An intersection of these two shadows determines a point that indicates both the time of day and the day of the year. As the time of day changes, the intersection point moves circumferentially across the chart 16, while the sun travels from one side of the analemma 18 to the other. As the season changes, the variation in the sun's declination moves the shadow of the equatorial ring 20 in a direction parallel to the longitudinal axis of the analemma 18.

The chart 16 is graduated by a set of equally spaced, straight hour lines 38, parallel to the analemma 18, that represent the hours of the day. Successive hour lines 38 are separated by fifteen degrees on the surface of the cylinder defined by the chart 16. A set of perpendicular date lines 40, parallel to the equatorial ring 20 indicate the days of the year, divisions of ten days each being convenient, as shown in FIG. 7.

Variations between apparent solar time and mean solar time are compensated by the curvature of the analemma 18 which causes the analemma shadow to be displaced circumferentially in accordance with the values called for by the equation of time. The displacement is a function of the width of the analemma 18 at the longitudinal point where it is struck by the sun's rays reaching the point of interstection with the shadow of the equatorial ring 20. Therefore, the displacement varies as the sun's declination changes.

If the analemma 18 is properly shaped in accordance with the equation of time, its configuration approximates that of a figure eight (as shown in FIG. 5). For use in the Northern hemisphere, its smaller loop 42 is farthest from the ring 20 and its larger loop 44 is mostly within the ring. It will be noted that, except for the two extreme ends and the cross-over point at the neck 46, the analemma's shadow always has two points of intersection A and B with the shadow of the ring 20. The selection of the intersection point that should be read depends upon the time of year. The point on the surface of the analemma 18 casting the shadow that should be read moves up the analemma along one side 48 of the smaller loop 42, crosses the neck 46 and continues up the opposite side 50 of the larger loop 44. Upon reaching the top end of the analemma 18, the true shadow moves down the untraversed side 51 of the larger loop 44, again crosses the neck 46, and continues down the untraversed side 52 of the smaller loop 42.

For convenience in reading the chronometer 10, the analemma 18 may be thought of as divided along an immaginary vertical plane passing through its longitudinal axis. The side 48 of the small loop 42 on one side of the plane 50 and the large loop 44 on the opposite side of the plane are painted red. The remainder of the analemma 18 is painted green. From the twenty-second of June, until the twenty-second of December, the correct reading is indicated by the intersection point A of the shadows cast by the red side of the analemma and the ring 20. For the rest of the year, the shadow of the green side and that of the ring 20 are used, indicating the point B. In FIG. 7, point A indicates 10:57 on September 10. Alternately, point B indicates 11:02 on April 3.

A careful examination of the equation of time reveals that there is no theoretically perfect shape for an analemma that can be read year round. However, the analemma 18, shown in FIG. 6, which closely approximates a perfect analemma, can be made by first arranging the correctional values of the corresponding dates for each point along its true longitudinal axis C (which is aligned with the celestial pole). The mean correctional value of any given declination is then used as the diameter of a symmetrical analemma. When the body thus constructed is mounted on the chart support 14, the shaft 26 is connected at two points, 53 and 54, spaced from the centers of the cross-pieces 22 so that the axis of symmetry C' is slightly askew, when compared to the true longitudinal axis C. The top of the analemma, representing December 22, is displaced directly away from the line on the chart 16 below that representing mean solar noon. It is then displaced an equal amount in a perpendicular direction to the West. The opposite end is displaced in the opposite direction so that the longitudinal center point of the analemma 18 remains undisplaced. Quantitatively, the displacement is such that the shadow cast by each end of the analemma 18 is moved on the chart by 1.25 minutes of time. The error introduced by the analemma 18 is thus reduced to only a matter of seconds, with the possible exception of the neck 46 where zero displacement cannot be achieved. The analemma need not be moved and is used throughout the year.

It will be noted that while the solar chronometer 10 is of simple construction employing a minimum of components, it is capable of indicating both mean solar time and the day of the year. Although it has no moving parts, it does not require periodic repositioning or the mathematical application of a correction factor to compensate according to the equation of time. Readings can be determined easily and with accuracy because the point on the chart 16 that corresponds to the hour and date is indicated by the intersection of the approximately perpendicular shadows. Since the ring 20 is half the width of the chart 16, there are no confusing additional shadow boundaries present in the area of the intersection.

Another solar chronometer 55 that embodies many features of the present invention is generally similar in construction to the chronometer 10 and is shown in FIG. 8, corresponding components being indicated by the same reference numerals. It is particularly suited for use in high latitude regions where direct sunlight is sometimes available for considerably more than twelve hours of the day. At these locations, it is desirable to extend the sides of the chart 16 and chart support 14 upwardly forming an arc of more than 180 degrees and providing hour lines 38 as indicia of more than twelve hours. It is then found, however, that the side of the extended chart 14 nearest the sun casts a shadow on the side away from the sun, preventing a reading from being obtained.

To overcome this difficulty, the chart support 14 is formed by a main section **14*a* and two side sections 14*b* and 14*c*, the chart 16 being divided into three corresponding sections 16*a*, 16*b* and 16*c*. The side sections 14*b* and 14*c* are connected to the main section 14*a* by hinges that have a hinge axis parallel to the celestial pole and the longitudinal axis of the analemma 18. The side sections 14*b* and 14*c* are then raised into position one at a time and held by latches 58. The side section 14*b* or 14*c* that is not in use hangs downwardly from the main section 14*a*** so that it does not cast an interfering shadow.

Figure 9:
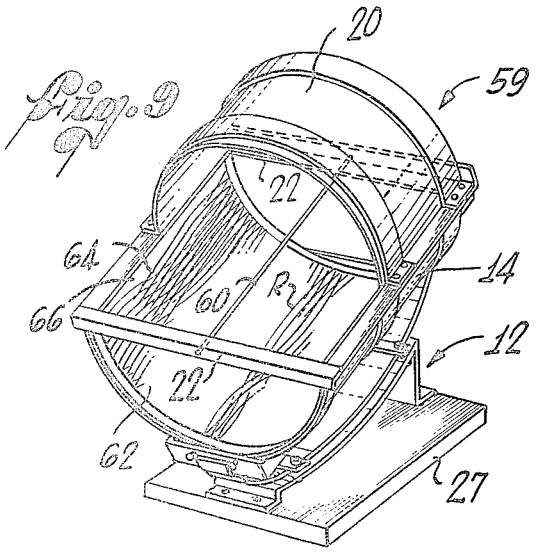
FIG. 9 is a pictorial view of a third embodiment of the invention in which a gnomon is used instead of an analemma.

A third embodiment of the invention 59, again using the same reference numerals for corresponding components, is shown in FIG. 9. It utilizes a gnomon 60, which is a thin straight shaft, instead of the contoured analemma 18. Correction of the time of day in accordance with the equation of time is then made by a chart 62 having two superposed sets of curved lines 64 and 66 that are generally parallel to the gnomon 60. A first set of lines 64 is used during only one half of the year, and the other set 66 is used during the other half. The two sets 64 and 66 are printed in different colors for ease of reading.

While particular forms of the invention have been illustrated and described, it will be apparent that various modifications can be made without departing from the spirit and scope of the invention.

I claim:

1. A solar chronometer comprising:

a style;

means for supporting said style in alignment in accordance with the celestial pole;

an equatorial member;

means for supporting said equatorial member in alignment with the equator; and a chart arranged to have two intersecting shadows cast thereon by said style and said equatorial member, said chart bearing hour indicia for indicating the time of day in accordance with the position of the intersection of said shadows.

2. The solar chronometer of claim 1, wherein said chart bears date indicia for indicating the day of the year in accordance with the position of the intersection of said shadows.

3. The the solar chronometer of claim 1, wherein said style is an analemma and said hour indicia include straight lines indicating the hours of the day.

4. The solar chronometer of claim 3, wherein said analemma has the shape of a three-dimensional figure eight.

5. The solar chronometer of claim 1, wherein said style is a gnomon and said hour indicia include lines that are curved in accordance with the equation of time.

6. The solar chronometer of claim 1, wherein said style is a gnomon and said chart has first and second sets of superposed lines thereon, the lines of said first set being curved to indicate the time of day during a first half year in accordance with the position of the intersection of said shadows, the lines of said second set being curved to indicate the time of day during a second half year in accordance with the position of the intersection of said shadows.

7. The solar chronometer of claim 1, wherein said chart has a surface that defines part of the interior of a cylinder, said surface bearing said indicia.

8. The solar chronometer of claim 7, wherein said equatorial member forms a portion of a ring, said ring having a width equal to about one half the width of said chart.

9. The solar chronometer of claim 1, wherein the equatorial member forms a portion of a ring.

10. The solar chronometer of claim 9, wherein said equatorial member includes a thin shadow casting edge and a thicker supporting member recessed from said edge.

11. A solar chronometer comprising:

an analemma;

means for supporting said analemma in alignment in accordance with the celestial pole;

an equatorial ring;

means for supporting said equatorial ring in alignment with the equator; and a chart defining a portion of the interior surface of a cylinder arranged to have two intersecting shadows cast thereon by said analemma and said equatorial ring, said chart bearing hour indicia for indicating the time of day in accordance with the position of the intersection of said shadows, and date indicia for indicating the day of the year in accordance with the position of the intersection of said shadows.

12. The solar chronometer of claim 11, wherein said hour indicia include a plurality of straight lines parallel to the longitudinal axis of said analemma.

13. The solar chronometer of claim 12, wherein said date indicia include straight lines perpendicular to said lines of said hour indicia.

14. The solar chronometer of claim 11, wherein said equatorial ring includes a thin shadow casting edge and a thicker supporting member recessed from said edge.

15. The solar chronometer of claim 11, wherein said ring has a width equal to about one half the width of said chart.

16. The solar chronometer of claim 11, wherein said analemma is divided into regions of two different colors to indicate the point of intersection of said shadows that should be read on a particular date.

17. The solar chronometer of claim 11, wherein said analemma has the shape of a three-dimensional figure eight having diameters corresponding to the mean correctional value of the equation of time and having an axis of symmetry that is slightly askew with respect to said lines of said hour indicia.

18. The solar chronometer of claim 11, wherein said chart comprises a main section, two side sections, and hinge means connecting said side sections to said main section.

19. A solar chronometer comprising:

an analemma in the shape of a three-dimensional figure eight;

means for supporting said analemma in alignment in accordance with the celestial pole;

an equatorial ring;

means for supporting said equatorial ring in alignment with the equator; and a chart defining a portion of the interior surface of a cylinder, said surface having approximately twice the width of said ring and being arranged to have two intersecting shadows cast thereon by said analemma and said equatorial ring, said chart also bearing hour indicia including a plurality of straight lines parallel to the longitudinal axis of said analemma and date indicia including a plurality of straight lines perpendicular to said lines of said hour indicia.

20. The solar chronometer of claim 19, wherein said chart comprises a main section, two side sections, and hinge means connecting said side sections to said main section.

21. The solar chronometer of claim 19, wherein said equatorial ring includes a thin shadow casting edge and a thicker supporting member recessed from said edge.

22. The solar chronometer of claim 19, wherein said analemma has the shape of a three-dimensional figure eight having diameters corresponding to the mean correctional value of the equation of time and having an axis of symmetry that is slightly askew with respect to said lines of said hour indicia.

* * * * *